US005351963A

United States Patent [19]

Baek

[11] Patent Number: 5,351,963

[45] Date of Patent: Oct. 4, 1994

[54] GOLF PUTTER INCLUDING ALIGNMENT AND LEVEL INDICATORS

[76] Inventor: Tae S. Baek, Hyundai Apt. 63-410, Apgujung-dong, Kangnam-gu, Seoul 135-110, Rep. of Korea

[21] Appl. No.: 64,133

[22] Filed: Jul. 23, 1993

[30] Foreign Application Priority Data

Sep. 27, 1991 [KR] Rep. of Korea ..... 91-17161

[51] Int. Cl.[5] ..... A63B 69/36

[52] U.S. Cl. ..... 273/187.4; 273/187.6

[58] Field of Search ..... 273/186.2, 187.4, 187.5, 273/187.6, 163 R, 164.1

[56] References Cited

U.S. PATENT DOCUMENTS 3,468,545 9/1969 Anderson ..... 273/187.6
3,548,504 12/1970 Sykes ..... 273/187.6 X
3,979,125 9/1976 Lancellotti ..... 273/162 BX
4,231,576 11/1980 Perkins ..... 273/187.4

*Primary Examiner*—George J. Marlo

[57] ABSTRACT

The present invention relates to a structure of putter in golf club, and it is structured such that upper and lower confirming indicator boards for zero point sighting and a level are provided, so that in case of executing a putting exercise, it is made to enable to confirm whether or not the putter is exactly made to be arched against the ground surface via a level, and at the same time, an exerciser (user) exercises by confirming directly with one eye via a measuring device weather or not the eye is exactly positioned at a place being perpendicular against a ball so as to be accustomed with a putting posture to a body, and in case when executing a game on a real green, a putting sense accustomed by the exercise is exerted with self-reliable sense so that a self-reliable sense and exactitude of the putting is provided.

3 Claims, 4 Drawing Sheets

GOLF PUTTER INCLUDING ALIGNMENT AND LEVEL INDICATORS

FIELD OF THE INVENTION

The present invention relates to a structure of putter in golf club, which is made to learn an exact putting pose to a body for an exerciser, and when one would enter to an actual game, making to exert a putting sense trained by the exercise with self-reliable feeling so as to provide an exactitude and self-reliance of putting.

More particularly, it relates to a structure of putter in which a measuring device for sighting zero point is provided so as to be able to exercise with directly confirming by oneself with a level whether or not the putter is correctly made to be arched against the ground surface when one does a putting exercise on the ground surface in horizontal state by providing the level to the putter, at the same time, so as to be able to do the putting exercise in a state that an exerciser oneself clearly has confirmed whether or not an eye is exactly positioned at a position being perpendicular against a ball, and one would usually execute exercise with the putter like this structure so as to be able to freely play the reliable and exact putting on real green.

BACKGROUND OF THE INVENTION

Generally, it is almost a case that amateur golfers concentrate one's energy in maximum for flying a ball by a golf club and when it is got on the green, feeling safe. However, it is not for professional golfers. They understand that what all of victory and defeat are determined on the green is preferably today's game.

That is, there are many a case that the amateurs spoil the score by neglecting to pay attention for a point that major essential point for decreasing the score resides in putting which seems very easy and simple, but it is no exaggeration at all even to say that the professionals, especially famous professionals who participate in tournament games in these days and obtain good scores, stake all things to the putting.

In carrying out the putting, one must hit with imaging an exact putting line (imaginary line the ball rolls) against a hole, and at this moment, an exact putting would get accomplished only by carrying out the putting by rendering a hitting point of hitting surface of the putter to hit a center of a ball perpendicularly along the aforementioned putting line.

However heretofore, the structures of the putters are made in every kind of all sorts in their forms and shapes and they have been used, and these have only brought some changes only for remaking and the like of the shaft and size and weight of the putter so as to suit a taste of every individual person, and a putter having a structure capable of compatibly using either in exercise or in contest capable of either training or correcting the putting posture while a person oneself instantly confirms whether or not one makes the putter to be exactly arched or whether or not the position of eye is exactly positioned at a location being to be perpendicular against the ball, has never been offered.

SUMMARY OF THE INVENTION

Accordingly, the present invention is constructed so as to learn and train a putting address posture while a person oneself clearly confirms whether or not one makes the putter to be exactly arched on the ground surface upon usually exercising the putting and also confirms a selection of exact position of the eye, so that the putting posture trained to a body as these can be reliably applied on green as well, and when reviewing firstly as an aiming incentive, it will be as follows.

The aiming incentive of the present invention is that a separate measuring device is provided by considering a shooting posture, and at the same time a level capable of confirming whether or not a horizon (arch) is made against the ground surface is provided so that the putting posture and sense can be trained by the training.

And, a principle of the measuring device applied to the present invention is illustrated as a schematic structure of FIG. 7.

That is, in viewing from a shooting posture of a rifle, "P" is a fiducial point corresponding to the position of eye, "Q" is a backsight, and "R" corresponds to a foresight.

Accordingly, in viewing from the fiducial point "P", when a center hole Q1 of the backsight Q located at a center line C and a center indicating plate R1 indicated at a center of the foresight R are aligned, they become a perpendicular state (zero point sighting).

On the other hand, thus in case when assuming that each center hole is perforated respectively by one, when a distance between the fiducial point and the backsight Q becomes short or long, "0" point sighting is obtained even by the center hole Q1 of the backsight Q and the center hole R1 of the foresight R, and these may not make an exact and prompt sighting.

That is, because it causes a result which becomes to "0" point sighting even if the fiducial point is changed, it is difficult to expect an exactitude.

Accordingly, it is desirable that a number of holes are perforated to the backsight Q, and same number of indicator means as tile holes of the backsight Q are provided to the foresight R.

On the other hand, the holes of the backsight and the indicator means of the foresight bring a result which becomes to an exact "0" point sighting when all of the holes of the backsight Q and the indictor means of the foresight R are aligned when viewing from the fiducial point P at a predetermined distance.

Because only when a distance between the fiducial point P and the backsight Q is always kept constant, they become to be aligned with the indicator means of the foresight R, consequently,it will be well done only when a position of eye corresponding to the fiducial point P shall be adjusted.

The novel features which are considered as characteristic for the invention are set forth in particular in the appended claims. The invention itself, however, both as to its structure, together with additional objects and advantages thereof, will be best understood from the following description of specific embodiments when read in connection with the accompanying drawings.

BRIEF DESCRIPTION OF THE DRAWINGS

For a better understanding of the invention, and to show how the same may be carried into effect, reference will now be made, by way of example, with respect to the accompanying drawings, in which:

FIG. 2 is a cross sectional view taken along II—II line in an assembled state of FIG. 1, FIG. 3(A) and 3(b) are plane views showing each confirming indicator board provided at upper and lower portions in a measuring device, in which FIGS. 4(A) and 4(B) are plane views showing interrelation of the upper and lower indicator boards, in which FIG. 4(A) shows a state that a lens of upper portion and an indicator means of lower portion are aligned, FIG. 4(B) shows a unaligned state.

Throughout the drawings, like reference numerals and symbols are used for designating like or equivalent parts or portions, for simplicity of illustration and explanation.

DETAILED DESCRIPTION OF THE PREFERRED EMBODIMENTS

The measuring device applied to the present invention is used with a thing having a principle as aforementioned above, and the structure of the present invention is as follows.

FIRST EMBODIMENT

Figure 1:
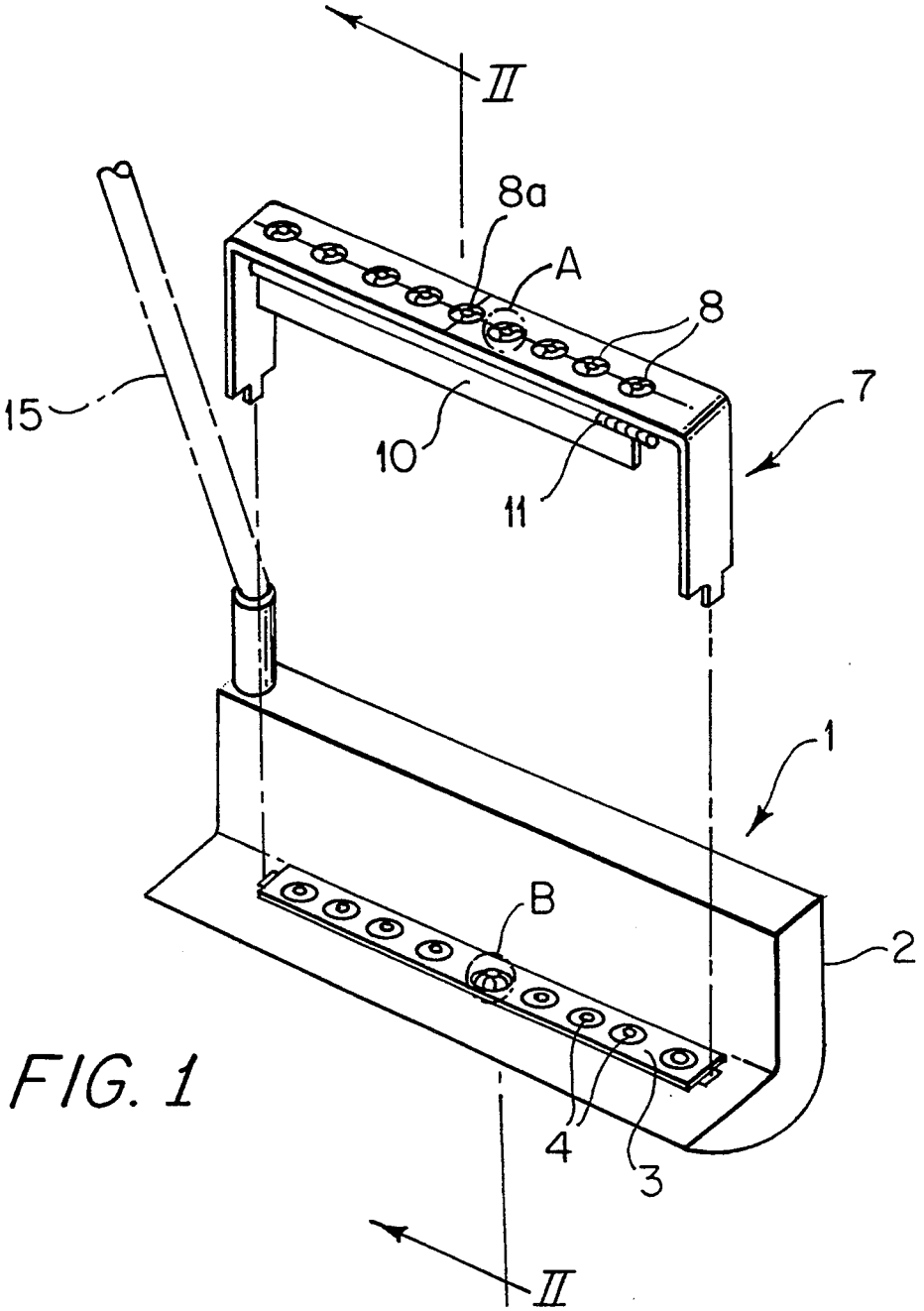
FIG. 1 shows a first preferred embodiment of the present invention, and is an exploded perspective view of an essential part of a putter according to the invention.
Figure 1A:
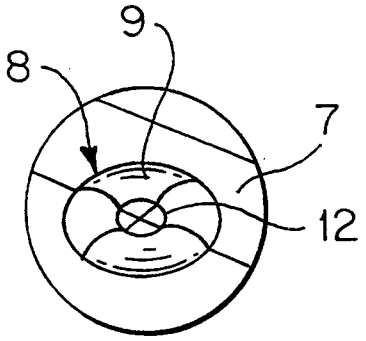
FIG. 1A is an enlarged perspective view of a portion in a site circle A in FIG. 1.
Figure 1B:
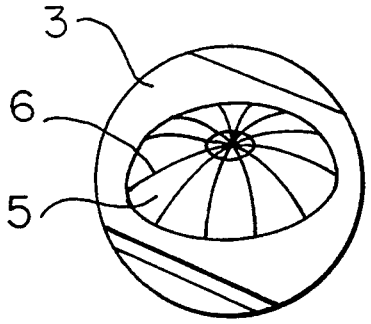
FIG. 1B is a similar enlarged view of parts in the site-circle B in FIG. 1.
Figure 2:
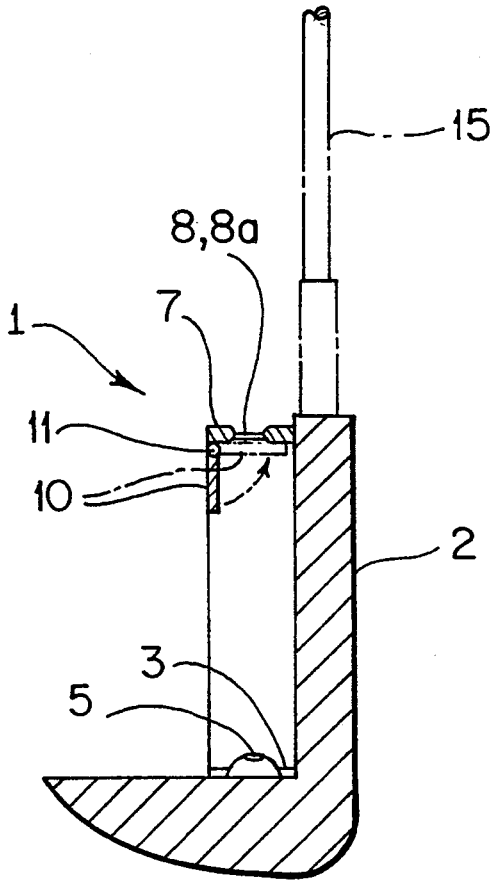
Figure 3A:
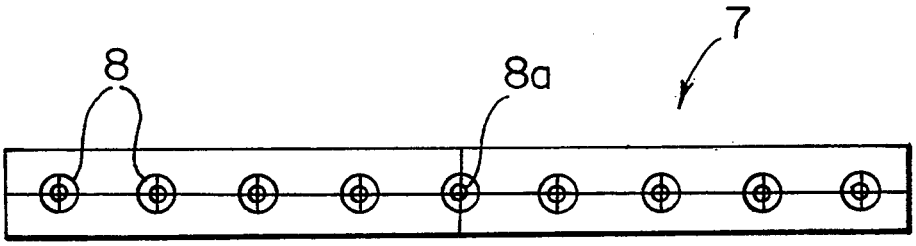
FIG. 3(A) shows a upper confirming indicator board.
Figure 3B:
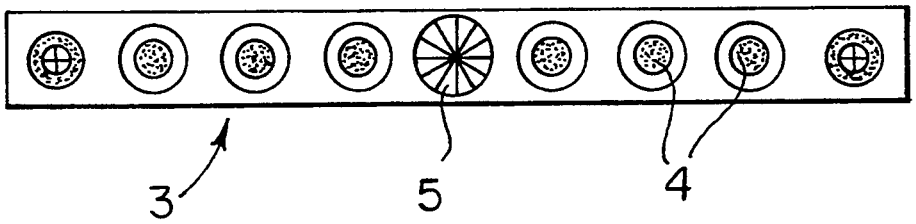
FIG. 3(B) shows a lower confirming indicator board.

FIG. 1 is an exploded perspective view of a portion showing a first preferred embodiment of the present invention, and FIGS. 2 to 4 show the structure of each part of the first embodiment.

In the drawings, a reference numeral 1 denotes a head, and numeral 2 denotes a ball hitting surface.

Rear portion (front side in FIG. 1) of the ball hitting surface 2 is made in flat surface, and a lower confirming indicator board 3 is provided on this flat surface.

A number of lower confirming indicator means 4 are processed by color painting with predetermined distance intervals on the lower confirming indicator board 3, a level 5 is mounted at a central portion of the lower confirming indicator board 3, and an isogonic scale lines 6 divided in equiangular with predetermined angles are notched on top surface of the level 5.

On the other hand, aforesaid lower confirming indicator board 3 is constructed by a separate panel and thereafter may be adhered integrally with the head 1, otherwise the lower confirming indictor means 4 are processed by color printing directly to the flat surface portion of the head 1 itself as well as the level 5 may be provided by inserting thereto, and this will be possible by a design change.

In the drawings, a reference numeral 7 depicts an upper confirming indicator board.

This indicator board 7 is constructed by a frame of inverted "U"-shape, and both bottom end portions of this indicator board 7 are inserted in parallel into the upper portion of the lower confirming indicator board 3 provided to the head 1 with keeping a predetermined distance therebetween and then assembled thereto so that a finished measuring device is made.

On the other hand, a multiplicity of through sighting means 8,8*a* provided with respective lens 9 are mounted in symmetry at the upper confirming indicator board 7 so that the lower confirming indicator means 4 and the level 5 can be seen, and a cover 10 capable of opening and closing elastically at an angle of 90 degree is coupled by a hinge 11 at bottom of the upper confirming indicator board 7.

Accordingly, the putting posture may be learned by executing the exercise in a state that the cover 10 is opened in the time of exercising, while it may be well done if any one attends by closing the cover 10 in the time of playing a game on the green.

On the other hand, the structure of the lens 9 of the through sighting means 8 and the conforming indicator means 4 does not make any difference when it is made by any structure as follows.

That is, it is desirable to make such that a central portion 12 of the lens 9 is made of flat lens so as to make a central portion 13 of the confirming indicator means 4 formed at lower portion to be seen well, while peripheral portions other than the central portion of the lens 9 are made of convex or concave lens so that any images appearing at area other than the central portion are to be seen indistinctly.

The reason is for making to enable to confirm whether or not they are more easily aligned in case of aligning the central portion 13 of the lower confirming indicator means 4 by the central portion 12 of the lens 9 upon using.

When reviewing the operation and effect of the invention of this application constructed as these by assuming that it would be used for an exercising object on flat green or at an exercising hall, it will be as follows.

First, it is executed by following method for learning the putting posture to a body by opening the cover 10 provided at the bottom of the upper confirming indicator board 7.

The head of the putter is placed behind the ball after establishing a target point in order to exactly execute the putting, but the putter is placed to make a line which connects a hitting point of the hitting surface 2 and the target point to become perpendicular against the hitting surface 2.

And next, while keeping in mind the line of the hitting surface 2 so as not to be moved, and while seeing the level 5 provided at the center of the lower indicator means through the through sighting means 8*a* provided at the center of the upper confirming indicator board 7, the level point is made to be exactly positioned at center of the level 5.

The reason is because a time being made as this is a state that the putter is made to be arched exactly against the ground surface as described previously, and the putter is already designed and offered so as to become this state.

And, because even any putter is manufactured on the basis of a state being exactly made to be arched at the manufacturing time, an exact putting can be expected only when the arching is exactly made.

Thus, in a state where the level point is located at the center of the level 5, all of the lower confirming indictor means 4 are aligned through the lenses 9 provided at the through sighting means 8 of others. At this moment, when the level point of the level 5 is located at the center and the center portions 13 of the lower confirming indicator means 4 are appeared by clearly aligning as in FIG. 4(A) at the central portions 12 of the lenses 9 of the whole respectively, the putter is exactly in a horizontal and perpendicular state.

When the putting is carried out in this state, the exact putting would be attained.

Figure 4A:
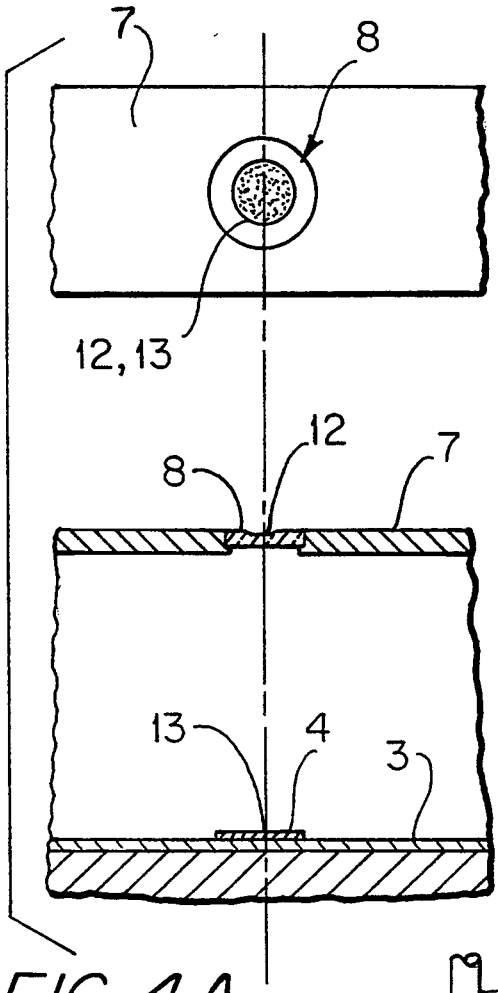
Figure 4B:
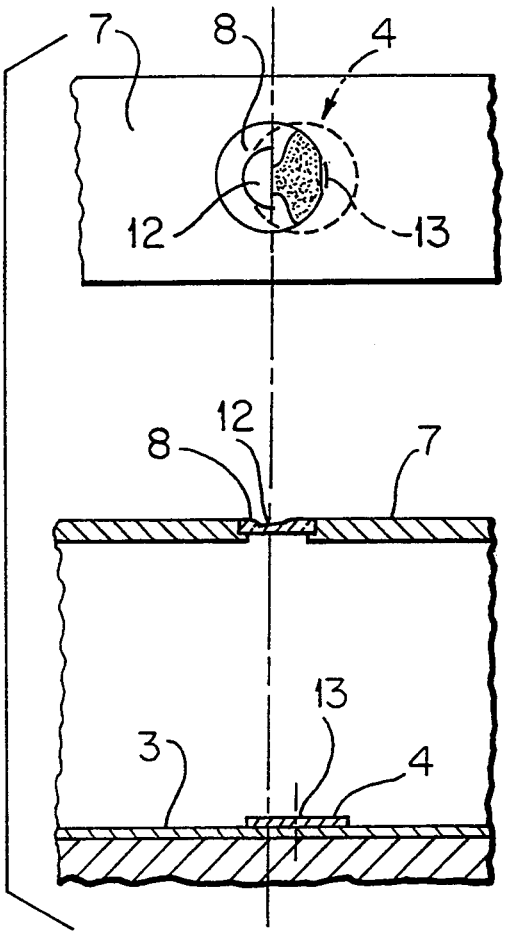

A state as shown in FIG. 4(B) is a state that a position of eye is not located at the center of the ball, an aligned position as shown in FIG. 4(A) must be found out.

On the other hand, a putting exercising place is a flat place such as an office room, a dining room or an indoor exercising hall, and the present invention is manufactured so as to be able to exactly execute the putting under the condition as these, and since firstly not only the arched state (horizontal state) of the putter can be correctly known upon addressing, but also the position of the eye would be exactly made, when exercising by taking continuously a predetermined posture as these, an exact putting posture is naturally accustomed to a body in the time of gripping the putter, therefore very great help can be obtained in the putting on the real green.

There are almost none of flat (horizontal) state in the state of the real green as the dining room, the office room, and the indoor exercising hall.

However, as described previously, when if a person continuously and repeatedly exercises in accordance with the present invention and can exactly make the putter head to be arched as trained to a body and as accustomed to eyes as in the time of usual exercise upon the putting address, the present invention will inspire a self-reliable sense so as to enable the reliable putting without being settled even on the entirely unaccustomed green.

SECOND EMBODIMENT

Figure 5:
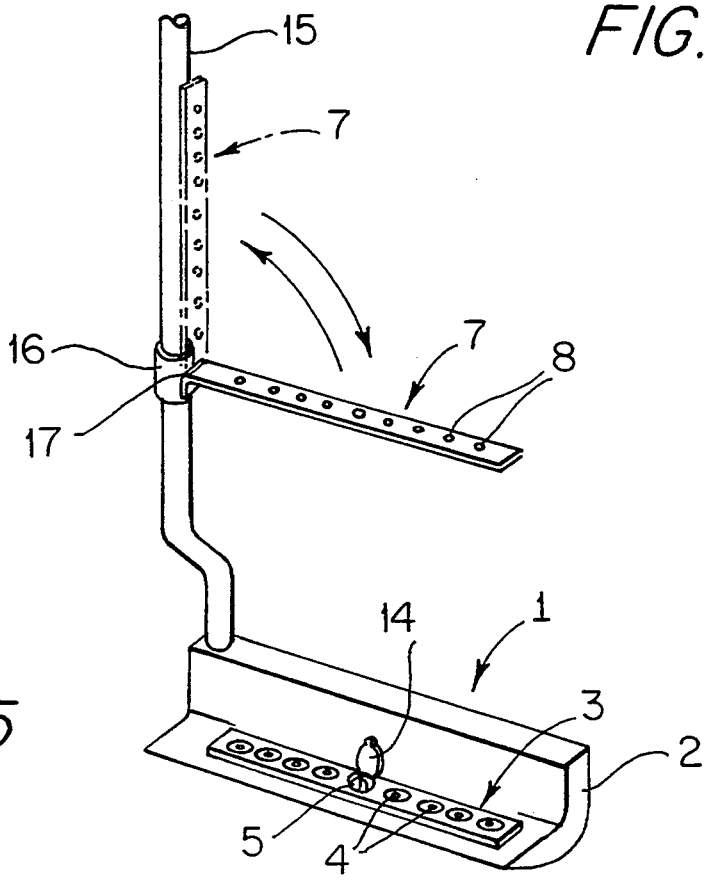
FIG. 5 is a second embodiment of the present invention, and shows a state that the upper confirming indicator board is mounted to a shaft.

This is a structure capable of having same operation and effect as the first embodiment, and a structure of the second embodiment is as shown in FIG. 5.

The lower confirming indicator board 3 formed with a level 5 and the confirming indicator means 4 is provided at the flat surface portion of rear of the hitting surface 2 of the head 1, and a level cover 14 coupled with a hinge on the top of the level 5 is provided, and the upper confirming indicator board 7 is firmly fixed by a fixing member 16 to the neck of the head 1 or to the shaft 15, and the indicator board 7 is coupled by a hinge 17 by the fixing member 16 so as to be folded and unfolded through the hinge toward up and down.

Accordingly, in the time of exercising, the level cover 14 is opened, and the upper confirming indicator board 7 is unfolded to be horizontal, and the horizon and the perpendicularity are set so as to execute the exercise.

A method for setting the horizon and the perpendicularity is same as in the first embodiment, and in case of playing a game on the green, if only the upper confirming indicator board 7 is folded in vertical and simultaneously the level cover 14 is simply shut, the game can be carried out.

On the other hand, in the second embodiment, the lower confirming indicator board 3 may also be provided to the top surface of the head 1.

THIRD EMBODIMENT

Figure 6:
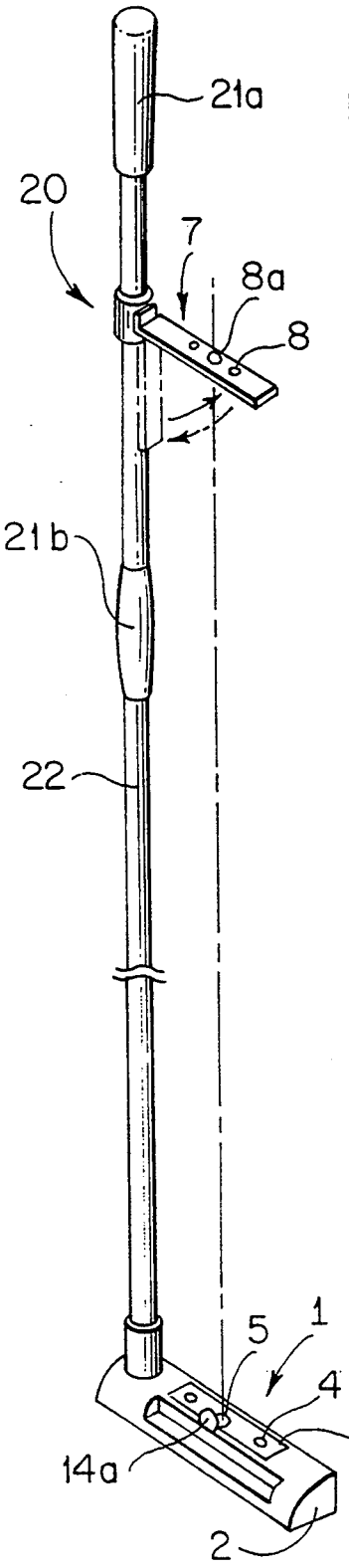
FIG. 6 is a third embodiment, and is a perspective view of a state that the upper and lower confirming indicator boards are mounted to a long putter.
Figure 7:
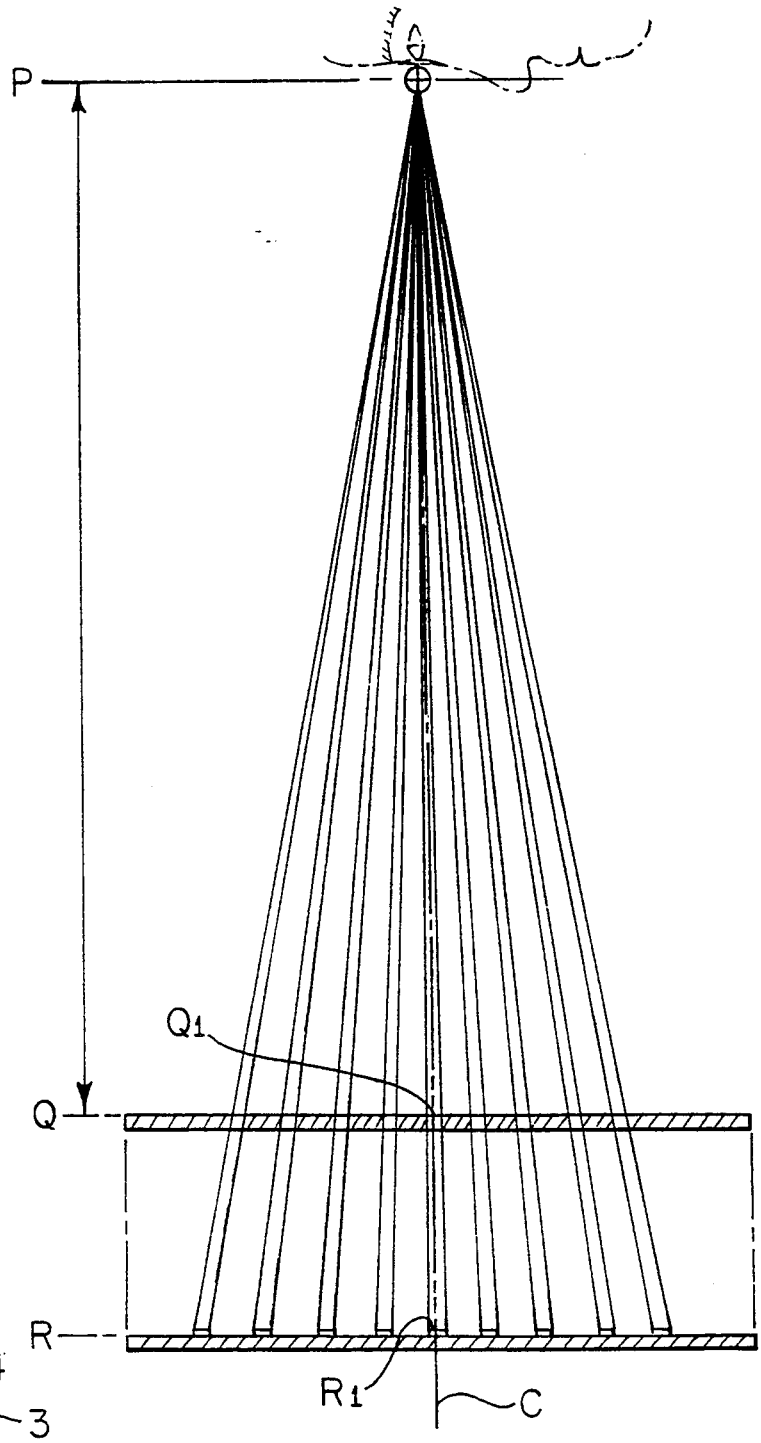
FIG. 7 is a schematic diagram illustrating for explaining the measuring device of the present invention.

The structure of the third embodiment of the present invention is as shown in FIG. 6.

The putter of FIG. 6 is a long putter 20 which is a putter of different form from the structure of the putter of the first embodiment and the second embodiment.

This long putter 20 has a structure in which its length comes up to the chest portion, and the putting is carried out in a state that a upper grip 21*a* is gripped by left hand and a lower grip 21*b* is gripped by right hand, and the shaft 22 is provided in perpendicular against the head 1.

Accordingly, in structuring the invention to the long putter 20, a level 5 provided with a level cover 14*a* and the lower confirming indicator board 3 formed with the confirming indicator means 4 are adhered and fixed to the flat portion of the top surface of the head 1, and the upper confirming indicator board 7 is provided between the upper and lower grips 21*a*,21*b* of the shaft 22, and the aforesaid upper confirming indicator board 7 is mounted by a hinge 17*a* to a fixing member 16*a* so as to enable to be unfolded to a horizontal direction and to be folded to a vertical direction.

At this moment, the number of the through sighting means 8 and the confirming indicator means 4 provided at the upper and lower confirming indicator boards 3,7 is appropriately constituted.

In case when the long putter 20 made in these structure is used for exercise, the upper confirming indicator board 7 is unfolded to be perpendicular against the shaft, and the cover 14*a* of the level 5 provided to the lower confirming indicator board 3 is opened, and thereafter the exercise is carried out by confirming the horizontal and perpendicular state, and in case of playing a game on the green, one may attend the game in a state that aforesaid upper confirming indicator board 7 is folded to be parallel with the shaft, and the level 5 is shut by the cover 14*a*.

As reviewed above, the present invention serves function enabling firstly to confirm whether or not the putter is exactly made to be arched against the ground surface in the time of exercise, and also enabling to confirm whether or not the perpendicular state of the eye against the ball is maintained by the upper and lower confirming indicator boards 3,7 at such state.

On the other hand, in case when exercising in accordance with the present invention at the office room, the dining room, and the indoor exercising hall, the exercise is carried out as described previously in a state that the cover 10 provided at the bottom of the upper confirming indicator board 7 is opened. And, also in case of being on the field, the exercise may be carried out in a state that the cover 10 is opened at immediately before the game. When the game is practically started, one attends the game in a state that the cover 10 is shut. This is because the game must be carried out necessarily in accordance with the golf regulation.

However, during the game, in case where it is judged that an arching was unstably made or else the position of the eye of oneself was wrong in the time of address in respect of a failure of the putting at any hole, since an exercise swing is allowed until before the tee shot of next hole in a state that said hole is made to hole out, it is possible either to confirm an exact state of arch by opening the cover 10 or to confirm once again the location of the eye. By doing like these, self-reliable sense can be obtained in the putting on the next hole. Then, the putter of the present invention which renders to have a spiritual self-reliable sense like these can obviously give the putting filled by a self-reliable sense, therefore such putting will just become a shorter way enabling to make good score.

Accordingly, the putter of the present invention can be a putter for exercise and for game which is capable of leading to a shorter way of good score.

It will be understood that each of the elements described above, or two or more together, may also find a useful application in other types of constructions differing from the types described above.

While the invention has been illustrated and described as embodied in a structure of putter in golf club, it is not intended to be limited to the details shown, because various modifications and structural changes may be made without departing in any way from the spirit of the present invention.

Without further analysis, the foregoing will so fully reveal the gist of the present invention that others can, by applying current knowledge, readily adopt it for various applications without omitting features that, from the standing point of prior art, fairly constitute essential characteristics of the generic or specific aspects of this invention.

What is claimed is:

1. In a known putter in which a head 1 is provided at bottom of a shaft 15 and one side surface is made of a hitting surface;

a structure of putter in golf club which is characterized in that:

a lower confirming indicator board 3 in which a rear portion of said hitting surface 2 is made of flat surface portion, a level 5 is provided at a central portion on said flat surface portion, and a multiplicity of confirming indicator means 4 are processed by color printing with predetermined distance intervals;

a upper confirming indicator board 7 formed with a multiplicity of through sighting means 8,8*a* provided with lenses 9 so as to enable to sight through toward the lower confirming indicator means 4 and level 5 on the top side of said lower confirming indicator board 3, is provided by coupling in parallel therebetween with keeping a predetermined distance;

a cover 10 capable of opening and closing at an angle of 90 degree is coupled by a hinge 11 at bottom of said upper confirming indicator board 7.

2. Structure of putter in golf club as defined in claim 1, which is characterized in that said upper confirming indicator board 7 is mounted by a hinge 17 to a shaft 15 so as to be possible to fold and unfold at an angle of 90 degree with keeping a predetermined distance with the lower confirming indicator board 3, and a cover 14 is provided to a level 5.

3. Structure of putter in golf club as defined in claim 2, which is characterized in that the lower confirming indicator board 3 is adhered and fixed to top surface (upper surface of the hitting surface) of the head.

* * * * *